US009037466B2

(12) United States Patent
Bodin et al.

(10) Patent No.: US 9,037,466 B2
(45) Date of Patent: May 19, 2015

(54) EMAIL ADMINISTRATION FOR RENDERING EMAIL ON A DIGITAL AUDIO PLAYER

(75) Inventors: William K. Bodin, Austin, TX (US); David Jaramillo, Lake Worth, FL (US); Jerry W. Redman, Cedar Park, TX (US); Derral C. Thorson, Austin, TX (US)

(73) Assignee: Nuance Communications, Inc., Burlington, MA (US)

( * ) Notice: Subject to any disclaimer, the term of this patent is extended or adjusted under 35 U.S.C. 154(b) by 861 days.

(21) Appl. No.: 11/372,323

(22) Filed: Mar. 9, 2006

(65) Prior Publication Data

US 2007/0213986 A1 Sep. 13, 2007

(51) Int. Cl.

| | |
|---|---|
| ***G10L 13/00*** | (2006.01) |
| ***G10L 25/00*** | (2013.01) |
| ***G10L 13/04*** | (2013.01) |
| ***G10L 25/48*** | (2013.01) |

(52) U.S. Cl.

CPC ..... *G10L 13/043* (2013.01); *G10L 25/48* (2013.01)

(58) Field of Classification Search

CPC ..... G10L 21/06; G10L 13/00; G10L 25/48; G10L 13/043

USPC ..... 704/260

See application file for complete search history.

(56) References Cited

U.S. PATENT DOCUMENTS

| | | | | |
|---|---|---|---|---|
| 6,061,718 | A * | 5/2000 | Nelson | 709/206 |
| 6,178,511 | B1 | 1/2001 | Cohen et al. | |
| 6,219,638 | B1 * | 4/2001 | Padmanabhan et al. | 704/235 |
| 6,240,391 | B1 * | 5/2001 | Ball et al. | 704/270 |
| 6,266,649 | B1 | 7/2001 | Linden et al. | |
| 6,311,194 | B1 | 10/2001 | Sheth et al. | |
| 6,343,329 | B1 * | 1/2002 | Landgraf et al. | 709/246 |
| 6,510,413 | B1 * | 1/2003 | Walker | 704/258 |
| 6,563,770 | B1 * | 5/2003 | Kokhab | 369/30.08 |
| 6,909,708 | B1 * | 6/2005 | Krishnaswamy et al. | 370/352 |
| 6,944,591 | B1 * | 9/2005 | Raghunandan | 704/235 |
| 6,975,989 | B2 * | 12/2005 | Sasaki | 704/260 |
| 6,976,082 | B1 * | 12/2005 | Ostermann et al. | 709/231 |

(Continued)

FOREIGN PATENT DOCUMENTS

| | | |
|---|---|---|
| JP | 2004-193859 | 7/2004 |
| WO | WO 0182139 | 11/2001 |
| WO | WO 2005/106846 | 11/2005 |

OTHER PUBLICATIONS

Text to Speech MP3 with Natural Voices 1.71, Published Oct. 5, 2004.

(Continued)

*Primary Examiner* — Richemond Dorvil

*Assistant Examiner* — Michael Ortiz Sanchez

(74) *Attorney, Agent, or Firm* — Wolf, Greenfield & Sacks, P.C.

(57) ABSTRACT

Methods, systems, and computer program products are provided for email administration for rendering email on a digital audio player. Embodiments include retrieving an email message; extracting text from the email message; creating a media file; and storing the extracted text of the email message as metadata associated with the media file. Embodiments may also include storing the media file on a digital audio player and displaying the metadata describing the media file, the metadata containing the extracted text of the email message.

21 Claims, 6 Drawing Sheets

(56) References Cited

U.S. PATENT DOCUMENTS

| | | | | |
|---|---|---|---|---|
| 6,981,023 | B1 * | 12/2005 | Hamilton et al. | 709/206 |
| 7,039,643 | B2 | 5/2006 | Sena et al. | |
| 7,062,437 | B2 * | 6/2006 | Kovales et al. | 704/260 |
| 7,130,850 | B2 | 10/2006 | Russell-Falla et al. | |
| 7,171,411 | B1 | 1/2007 | Lewis et al. | |
| 7,356,470 | B2 * | 4/2008 | Roth et al. | 704/270 |
| 2001/0027396 | A1 * | 10/2001 | Sato | 704/260 |
| 2001/0047349 | A1 | 11/2001 | Easty | |
| 2001/0049725 | A1 * | 12/2001 | Kosuge | 709/206 |
| 2001/0054074 | A1 | 12/2001 | Hayashi | |
| 2002/0013708 | A1 | 1/2002 | Walker et al. | |
| 2002/0032776 | A1 | 3/2002 | Hasegawa et al. | |
| 2002/0095292 | A1 | 7/2002 | Mittal et al. | |
| 2002/0110248 | A1 | 8/2002 | Kovales et al. | |
| 2002/0161578 | A1 * | 10/2002 | Saindon et al. | 704/235 |
| 2002/0161579 | A1 * | 10/2002 | Saindon et al. | 704/235 |
| 2002/0163533 | A1 * | 11/2002 | Trovato et al. | 345/728 |
| 2002/0178000 | A1 * | 11/2002 | Aktas et al. | 704/235 |
| 2002/0178001 | A1 | 11/2002 | Balluff et al. | |
| 2002/0184028 | A1 * | 12/2002 | Sasaki | 704/260 |
| 2002/0194286 | A1 | 12/2002 | Matsuura et al. | |
| 2003/0028380 | A1 * | 2/2003 | Freeland et al. | 704/260 |
| 2003/0033331 | A1 | 2/2003 | Sena et al. | |
| 2003/0051083 | A1 * | 3/2003 | Striemer | 710/72 |
| 2003/0055868 | A1 | 3/2003 | Fletcher et al. | |
| 2003/0110272 | A1 | 6/2003 | du Castel et al. | |
| 2003/0126293 | A1 | 7/2003 | Bushey | |
| 2003/0139144 | A1 * | 7/2003 | Kitajima et al. | 455/69 |
| 2003/0151618 | A1 * | 8/2003 | Johnson et al. | 345/716 |
| 2003/0152203 | A1 * | 8/2003 | Berger et al. | 379/93.24 |
| 2003/0158737 | A1 * | 8/2003 | Csicsatka | 704/273 |
| 2003/0160770 | A1 | 8/2003 | Zimmerman | |
| 2004/0003394 | A1 | 1/2004 | Ramaswamy | |
| 2004/0005040 | A1 * | 1/2004 | Owens et al. | 379/93.24 |
| 2004/0041835 | A1 | 3/2004 | Lu | |
| 2004/0068552 | A1 | 4/2004 | Kotz et al. | |
| 2004/0172254 | A1 * | 9/2004 | Sharma et al. | 704/270.1 |
| 2004/0254851 | A1 | 12/2004 | Himeno et al. | |
| 2005/0002503 | A1 * | 1/2005 | Owens et al. | 379/93.24 |
| 2005/0071780 | A1 | 3/2005 | Muller et al. | |
| 2005/0076365 | A1 | 4/2005 | Popov et al. | |
| 2005/0108521 | A1 | 5/2005 | Silhavy et al. | |
| 2005/0191994 | A1 * | 9/2005 | May et al. | 455/412.2 |
| 2005/0192061 | A1 * | 9/2005 | May et al. | 455/563 |
| 2005/0226217 | A1 * | 10/2005 | Logemann et al. | 370/352 |
| 2005/0232242 | A1 | 10/2005 | Karaoguz et al. | |
| 2006/0008252 | A1 | 1/2006 | Kim | |
| 2006/0008258 | A1 * | 1/2006 | Kawana et al. | 386/124 |
| 2006/0020662 | A1 | 1/2006 | Robinson | |
| 2006/0031364 | A1 * | 2/2006 | Hamilton et al. | 709/206 |
| 2006/0047518 | A1 * | 3/2006 | Claudatos et al. | 704/275 |
| 2006/0052089 | A1 | 3/2006 | Khurana et al. | |
| 2006/0075224 | A1 | 4/2006 | Tao | |
| 2006/0136449 | A1 | 6/2006 | Parker et al. | |
| 2006/0140360 | A1 * | 6/2006 | Crago et al. | 379/88.18 |
| 2006/0155698 | A1 * | 7/2006 | Vayssiere | 707/6 |
| 2006/0159109 | A1 | 7/2006 | Lamkin et al. | |
| 2006/0173985 | A1 | 8/2006 | Moore | |
| 2006/0184679 | A1 | 8/2006 | Izdepski et al. | |
| 2006/0190616 | A1 | 8/2006 | Mayerhofer et al. | |
| 2006/0193450 | A1 * | 8/2006 | Flynt et al. | 379/88.13 |
| 2006/0195540 | A1 * | 8/2006 | Hamilton et al. | 709/206 |
| 2006/0224739 | A1 | 10/2006 | Anantha | |
| 2006/0233327 | A1 | 10/2006 | Roberts et al. | |
| 2006/0242663 | A1 * | 10/2006 | Gogerty | 725/34 |
| 2006/0288011 | A1 | 12/2006 | Gandhi et al. | |
| 2007/0027958 | A1 | 2/2007 | Haslam | |
| 2007/0061266 | A1 | 3/2007 | Moore et al. | |
| 2007/0073728 | A1 | 3/2007 | Klein et al. | |
| 2007/0078945 | A1 * | 4/2007 | Hsieh et al. | 709/217 |
| 2007/0083540 | A1 | 4/2007 | Gundia et al. | |
| 2007/0091206 | A1 | 4/2007 | Bloebaum | |
| 2007/0100836 | A1 * | 5/2007 | Eichstaedt et al. | 707/10 |
| 2007/0112844 | A1 | 5/2007 | Tribble et al. | |
| 2007/0117553 | A1 * | 5/2007 | Arnos | 455/414.4 |
| 2007/0118426 | A1 | 5/2007 | Barnes, Jr. | |
| 2007/0124802 | A1 | 5/2007 | Anton et al. | |
| 2007/0130589 | A1 | 6/2007 | Davis et al. | |
| 2007/0174326 | A1 | 7/2007 | Schwartz et al. | |
| 2007/0191008 | A1 | 8/2007 | Bucher et al. | |
| 2007/0192327 | A1 | 8/2007 | Bodin | |
| 2007/0192674 | A1 | 8/2007 | Bodin | |
| 2007/0192683 | A1 | 8/2007 | Bodin | |
| 2007/0192684 | A1 | 8/2007 | Bodin et al. | |
| 2007/0206738 | A1 * | 9/2007 | Patel et al. | 379/93.24 |
| 2007/0213857 | A1 | 9/2007 | Bodin | |
| 2007/0213986 | A1 | 9/2007 | Bodin | |
| 2007/0214147 | A1 | 9/2007 | Bodin et al. | |
| 2007/0214148 | A1 | 9/2007 | Bodin | |
| 2007/0214149 | A1 | 9/2007 | Bodin | |
| 2007/0214485 | A1 | 9/2007 | Bodin | |
| 2007/0220024 | A1 | 9/2007 | Putterman et al. | |
| 2007/0253699 | A1 | 11/2007 | Yen et al. | |
| 2007/0276837 | A1 | 11/2007 | Bodin et al. | |
| 2007/0276865 | A1 | 11/2007 | Bodin et al. | |
| 2007/0276866 | A1 | 11/2007 | Bodin et al. | |
| 2007/0277088 | A1 | 11/2007 | Bodin | |
| 2007/0277233 | A1 | 11/2007 | Bodin | |
| 2008/0034278 | A1 | 2/2008 | Tsou et al. | |
| 2008/0052415 | A1 | 2/2008 | Kellerman et al. | |
| 2008/0082576 | A1 | 4/2008 | Bodin | |
| 2008/0082635 | A1 | 4/2008 | Bodin | |
| 2008/0161948 | A1 | 7/2008 | Bodin | |
| 2008/0162131 | A1 | 7/2008 | Bodin | |
| 2008/0275893 | A1 | 11/2008 | Bodin et al. | |

OTHER PUBLICATIONS

Managing multimedia content and delivering services across multiple client platforms using XML, London Communications Symposium, xx, xx, Sep. 10, 2002, pp. 1-7.

PCT Search Report and Written Opinion International Application PCT/EP2007/050594.

Adapting Multimedia Internet Content for Universal Access, Rakesh Mohan, John R. Smith, Chung-Sheng Li, IEEE Transactions on Multimedia vol. 1, No. 1, p. 104-p. 144.

Office Action Dated May 24, 2006 in U.S. Appl. No. 11/420,018.

Office Action Dated Sep. 29, 2006 in U.S. Appl. No. 11/536,733.

Office Action Dated Jan. 3, 2007 in U.S. Appl. No. 11/619,253.

Office Action Dated May 24, 2006 in U.S. Appl. No. 11/420,016.

Office Action Dated May 24, 2006 in U.S. Appl. No. 11/420,015.

Office Action Dated Mar. 9, 2006 in U.S. Appl. No. 11/372,318.

Office Action Dated Mar. 9, 2006 in U.S. Appl. No. 11/372,329.

Office Action Dated Mar. 9, 2006 in U.S. Appl. No. 11/372,325.

Office Action Dated Mar. 9, 2006 in U.S. Appl. No. 11/372,323.

Office Action Dated Feb. 13, 2006 in U.S. Appl. No. 11/352,679.

Office Action Dated Feb. 13, 2006 in U.S. Appl. No. 11/352,824.

Office Action Dated Feb. 13, 2006 in U.S. Appl. No. 11/352,760.

Taiwanese Office Action for TW 102100598 mailed Apr. 15, 2014.

* cited by examiner

EMAIL ADMINISTRATION FOR RENDERING EMAIL ON A DIGITAL AUDIO PLAYER

BACKGROUND OF THE INVENTION

1. Field of the Invention

The field of the invention is data processing, or, more specifically, methods, systems, and products for email administration for rendering email on a digital audio player.

2. Description of Related Art

Many conventional digital audio players include display screens for displaying metadata associated with the media files supported by the digital audio players. Such digital audio players are often lightweight and portable making the digital audio players user friendly. Despite the fact that the digital audio players are lightweight, portable, and include display screens, such digital media players do not support providing conventional email because the digital audio players only support playing media files. There is therefore an ongoing need for email administration for rendering email on a digital audio player.

SUMMARY OF THE INVENTION

Methods, systems, and computer program products are provided for email administration for rendering email on a digital audio player. Embodiments include retrieving an email message; extracting text from the email message; creating a media file; and storing the extracted text of the email message as metadata associated with the media file. Embodiments may also include storing the media file on a digital audio player and displaying the metadata describing the media file, the metadata containing the extracted text of the email message.

Creating a media file may be carried out by creating an MPEG file and storing the extracted text of the email message as metadata describing the media file may be carried out by inserting the extracted text in the MPEG file. Inserting the extracted text in the MPEG file may be carried out by inserting the extracted text in an ID3 tag in the MPEG file.

Storing the extracted text of the email message as metadata describing the media file may be carried out by storing the extracted text in a metadata file associated with the media file. The metadata file may be implemented as eXtenxible markup language ('XML') file.

Embodiments may also include extracting text from the email message for audio rendering on the digital audio player; converting the text to speech; and recording the speech in the audio portion of the media file. Embodiments also include storing the media file on a digital audio player; displaying the metadata describing the media file; and playing the audio portion containing the speech.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
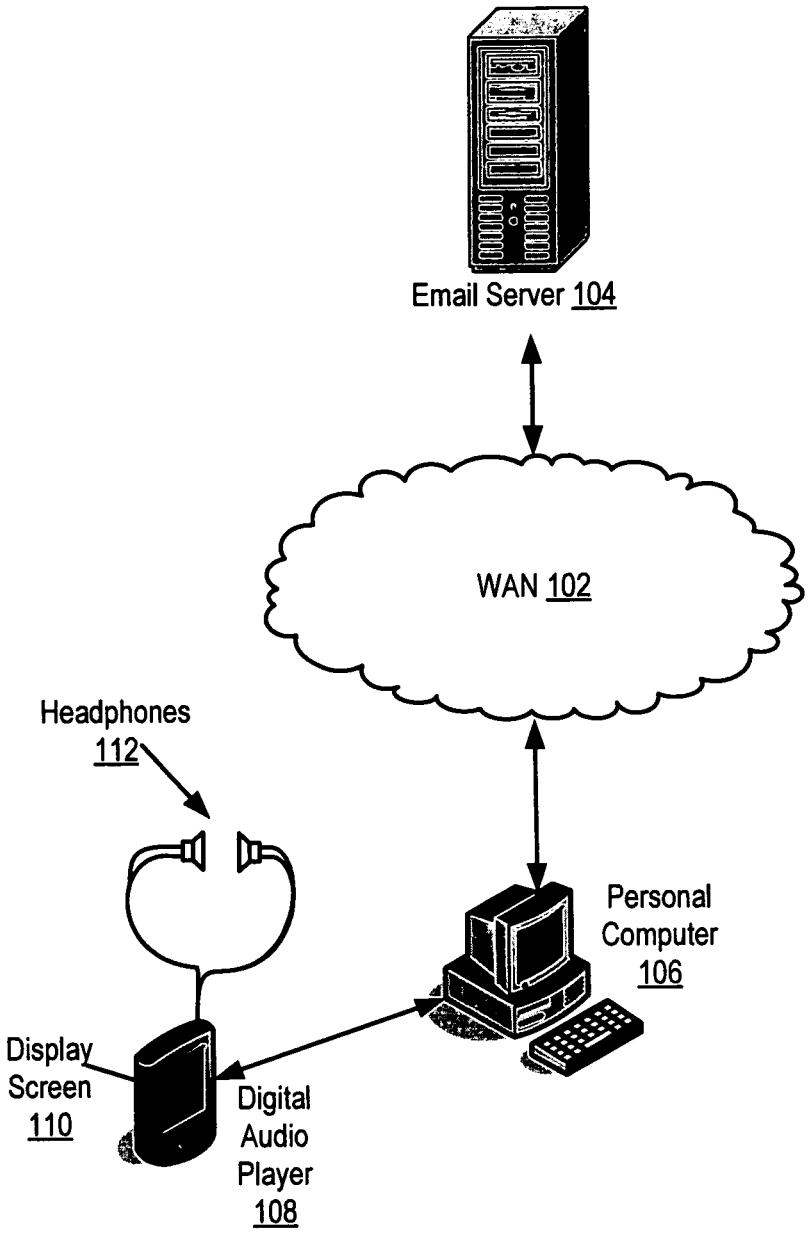
FIG. 1 sets forth a network diagram illustrating an exemplary system for email administration for rendering email on a digital audio player according to embodiments of the present invention.

Exemplary methods, systems, and products email administration for rendering email on a digital audio player according to embodiments of the present invention are described with reference to the accompanying drawings, beginning with FIG. 1. FIG. 1 sets forth a network diagram illustrating an exemplary system for email administration for rendering email on a digital audio player according to embodiments of the present invention. The system of FIG. 1 is capable of administering email for rendering email on a display screen of a digital audio player. The system of FIG. 1 is also capable of administering email for rendering portions of an email on a display screen of a digital audio player and portions of an email as audio.

The system of FIG. 1 includes an email server (104) for data communication coupled for data communications with a personal computer (106) through a wide area network (102) ('WAN'). An email server is an application that controls the distribution and storage of e-mail messages according to a particular email protocol. For example, Simple Mail Transfer Protocol ('SMTP'), is a protocol for sending email messages between servers. Most email systems that send mail over the Internet use SMTP to send messages from one server to another. Email messages can then be retrieved with an email client using either Post Office Protocol ('POP') or the Internet Map Access Protocol ('IMAP').

The system of FIG. 1 also includes a personal computer (106). The personal computer (106) of FIG. 1 is capable of supporting an email administration module that operates generally to administer email for rendering email on a display screen of a digital audio player according to embodiments of the present invention by retrieving an email message; extracting text from the email message; creating a media file; storing the extracted text of the email message as metadata associated with the media file; storing the media file on a digital audio player; and displaying the metadata describing the media file, the metadata containing the extracted text of the email message.

The personal computer (106) of FIG. 1 is capable of supporting an email administration module that operates generally to administer email for rendering portions of an email on a display screen of a digital audio player and portions of an email as audio by retrieving an email message; extracting text from the email message; creating a media file; storing the extracted text of the email message as metadata associated with the media file; storing the media file on a digital audio player; and displaying the metadata describing the media file thereby rendering extracted metadata text of the email message, extracting text from the email message for audio rendering on the digital audio player, converting the text to speech, recording the speech in the audio portion of the media file; storing the media file on a digital audio player; displaying the metadata describing the media file; and playing the audio portion containing the speech.

The system of FIG. 1 also includes a digital audio player (108). A digital audio player of FIG. 1 is capable of playing media files such as for example, MPEG files, AAC compressed .mp4 files, and others as will occur to those of skill in the art. The digital audio player of FIG. 1 also includes a display screen (110) capable of displaying information stored as metadata associated with media files of the file types supported by the digital audio player. The digital audio player also includes headphones (112) for audio presentation of the audio portions of media files supported by the digital audio player.

The arrangement of servers and other devices making up the exemplary system illustrated in FIG. 1 are for explanation, not for limitation. Data processing systems useful according to various embodiments of the present invention may include additional servers, routers, other devices, and peer-to-peer architectures, not shown in FIG. 1, as will occur to those of skill in the art. Networks in such data processing systems may support many data communications protocols, including for example TCP (Transmission Control Protocol), IP (Internet Protocol), HTTP (HyperText Transfer Protocol), WAP (Wireless Access Protocol), HDTP (Handheld Device Transport Protocol), and others as will occur to those of skill in the art. Various embodiments of the present invention may be implemented on a variety of hardware platforms in addition to those illustrated in FIG. 1.

Email administration for rendering email on a digital audio player in accordance with the present invention is generally implemented with computers, that is, with automated computing machinery. In the system of FIG. 1, for example, all the nodes, servers, and communications devices are implemented to some extent at least as computers. For further explanation, therefore, FIG. 2 sets forth a block diagram of automated computing machinery comprising an exemplary computer (152) useful in email administration for rendering email on a digital audio player according to embodiments of the present invention. The computer (152) of FIG. 2 includes at least one computer processor (156) or 'CPU' as well as random access memory (168) ('RAM') which is connected through a system bus (160) to processor (156) and to other components of the computer.

Stored in RAM (168) is an operating system (154). Operating systems useful in computers according to embodiments of the present invention include UNIX™, Linux™, Microsoft XP™, AIX™, IBM's i5/OS™, and others as will occur to those of skill in the art.

Also stored in RAM (168) is an email client (230). An email client is an application from which users can create, send and read e-mail messages. An email client sends and retrieves email messages from an email server that administers the sending and receiving of email to and from other email servers.

Also stored in RAM (232) is an email administration module (232). The email administration module (232) comprises computer program instructions capable of administering email for rendering email on a display screen of a digital audio player according to embodiments of the present invention by retrieving an email message; extracting text from the email message; creating a media file; storing the extracted text of the email message as metadata associated with the media file; storing the media file on a digital audio player; and displaying the metadata describing the media file, the metadata containing the extracted text of the email message.

The email administration module (232) comprises computer program instructions capable of administering email for rendering portions of an email on a display screen of a digital audio player and portions of an email as audio by retrieving an email message; extracting text from the email message; creating a media file; storing the extracted text of the email message as metadata associated with the media file; storing the media file on a digital audio player; and displaying the metadata describing the media file thereby rendering extracted metadata text of the email message, extracting text from the email message for audio rendering on the digital audio player, converting the text to speech, recording the speech in the audio portion of the media file; storing the media file on a digital audio player; displaying the metadata describing the media file; and playing the audio portion containing the speech.

Also stored in RAM (168) is a digital media player application (234). A digital media player application (234) is an application that manages media content such as audio files and video files. Such digital media player applications are typically capable of transferring media files to a digital audio player. Examples of digital media player applications include Music Match™, iTunes® and others as will occur to those of skill in the art.

Figure 2:
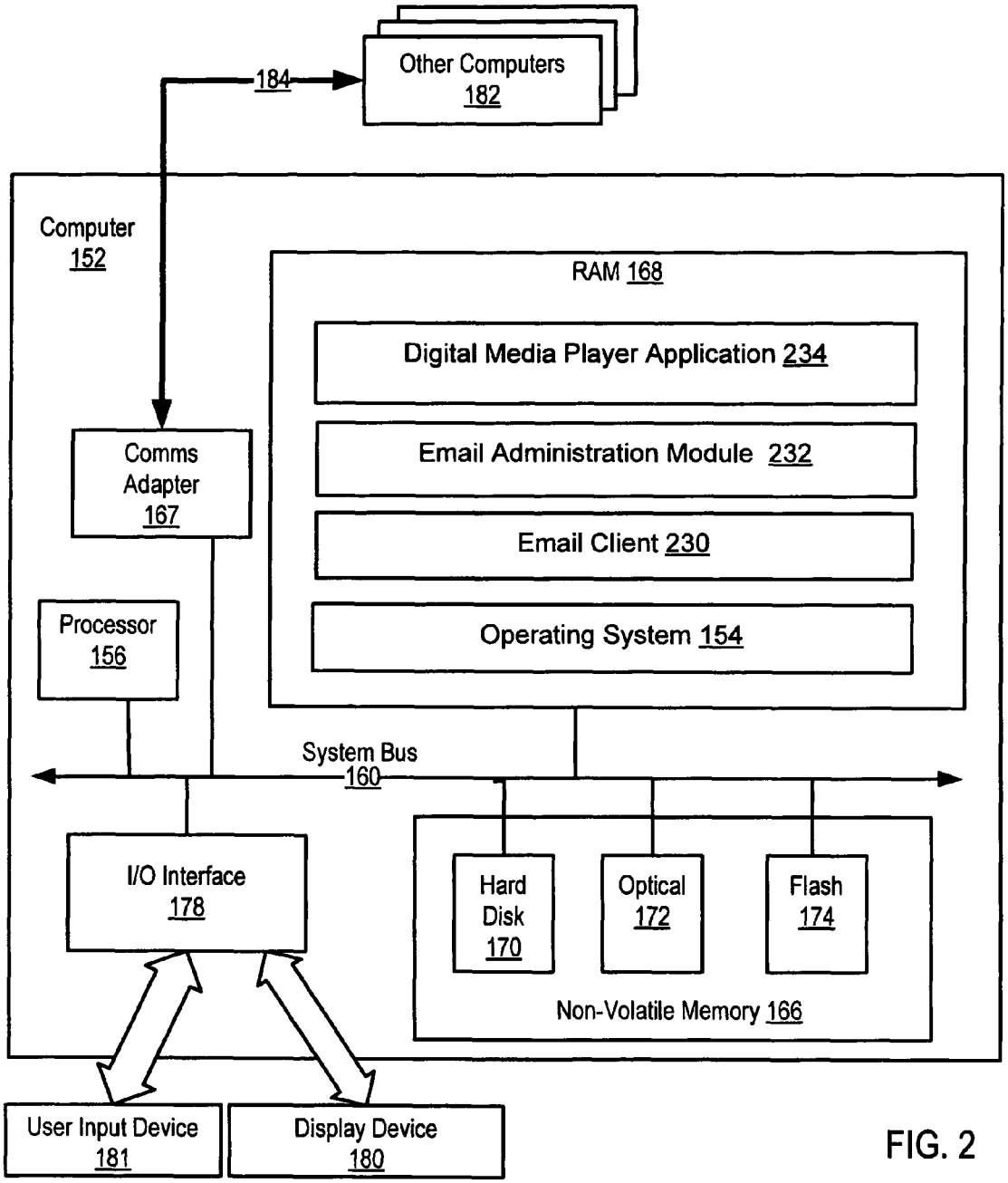
FIG. 2 sets forth a block diagram of automated computing machinery comprising an exemplary computer useful in email administration for rendering email on a digital audio player according to embodiments of the present invention.

The operating system (154), email client (230), email administration module (232) and digital media player application (234) in the example of FIG. 2 are shown in RAM (168), but many components of such software may be stored in non-volatile memory (166) also.

Computer (152) of FIG. 2 includes non-volatile computer memory (166) coupled through a system bus (160) to processor (156) and to other components of the computer (152). Non-volatile computer memory (166) may be implemented as a hard disk drive (170), optical disk drive (172), electrically erasable programmable read-only memory space (so-called 'EEPROM' or 'Flash' memory) (174), RAM drives (not shown), or as any other kind of computer memory as will occur to those of skill in the art.

The example computer of FIG. 2 includes one or more input/output interface adapters (178). Input/output interface adapters in computers implement user-oriented input/output through, for example, software drivers and computer hardware for controlling output to display devices (180) such as computer display screens, as well as user input from user input devices (181) such as keyboards and mice.

The exemplary computer (152) of FIG. 2 includes a communications adapter (167) for implementing data communications (184) with other computers (182). Such data communications may be carried out serially through RS-232 connections, through external buses such as USB, through data communications networks such as IP networks, and in other ways as will occur to those of skill in the art. Communications adapters implement the hardware level of data communications through which one computer sends data communications to another computer, directly or through a network. Examples of communications adapters useful for determining availability of a destination according to embodiments of the present invention include modems for wired dial-up communications, Ethernet (IEEE 802.3) adapters for wired network communications, and 802.11b adapters for wireless network communications.

Email administration for rendering email on a digital audio player may include both administering email for rendering email on a display screen of a digital audio player and administering email for rendering portions of an email on a display screen of a digital audio player and portions of an email as audio. For further explanation, FIG. 3 sets forth a flow chart illustrating an exemplary method for email administration for rendering email on the display screen of a digital audio player. The method of FIG. 3 includes retrieving (302) an email message (304). Retrieving (302) an email message (304) may be carried out by retrieving one or more email messages from an email server.

Figure 3:
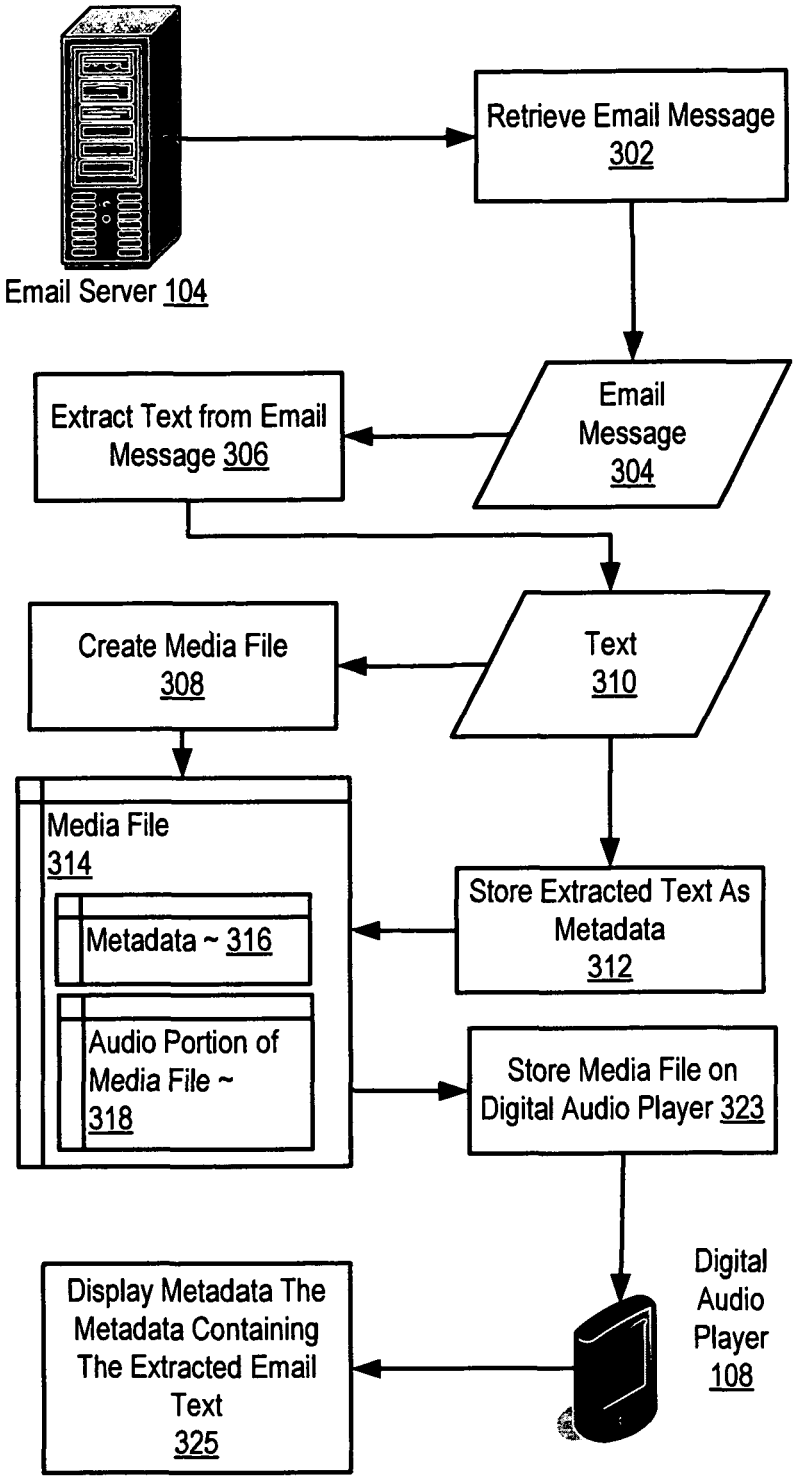
FIG. 3 sets forth a flow chart illustrating an exemplary method for email administration for rendering email on a digital audio player.

The method of FIG. 3 includes extracting (306) text (310) from the email message (304). The principal parts of an email message are the header, the body, and any attachments to the email. The header contains information including sender, intended recipient, date, intended courtesy copy recipients, subject of the message, and others as will occur to those of skill in the art. The body of the email message contains the content of the message itself. The attachments are typically files attached to the email message. Extracting text from the email message according to the method of FIG. 3 may include extracting text from an email message header. Extracting text from the email message according to the method of FIG. 3 may also include extracting text from an email message body. RFC 822 outlines a standard specifying the syntax for messages within the framework of email.

The method of FIG. 3 includes creating (308) a media file (314). Examples of media files include MPEG 3 ('.mp3') files, MPEG 4 ('.mp4') files, Advanced Audio Coding ('AAC') compressed files, Advances Streaming Format ('ASF') Files, WAV files, and many others as will occur to those of skill in the art. Creating a media file typically includes creating a media file that is supported by a digital audio player upon which email is to be rendered.

The method of FIG. 3 also includes storing (312) the extracted text (310) of the email message (304) as metadata (316) associated with the media file (314). Storing (312) the extracted text (310) of the email message (304) as metadata (316) associated with the media file (314) may be carried out by inserting the extracted text in the media file itself, such as by inserting the extracted text in an ID3 tag in an MPEG file as discussed below with reference to FIG. 4. Storing (312) the extracted text (310) of the email message (304) as metadata (316) associated with the media file (314) may be also be carried out by storing the extracted text in a metadata file associated with the media file such as by storing the extracted text in an eXtenxible markup language ('XML') library file associated with an AAC compressed MPEG 4 file as discussed below with reference to FIG. 5.

As discussed above, the extracting text from the email message may be extracting text from an email message header. Such header information may be extracted and stored in association with a predefined metadata field supported by the digital audio player upon which the extracted text is to be rendered. Consider for further explanation the following example. The identification of a sender of an email and the subject of the email is extracted from an email message and stored as metadata in association with a predefined metadata field for 'Artist' and 'Song' supported by an iPod digital audio player. In such an example, the extracted header information is rendered in predefined metadata fields on the iPod allowing a user to navigate the header information of the email as the user normally navigates the metadata of music files.

The extracted text from the email message may also include text from an email message body. Such extracted text of the body may also be associated with a predefined metadata field supported by the digital audio player upon which the extracted body text is to be rendered. Continuing with the example above, the extracted text from the body 'may be associated in the 'Song' field supported by an iPod digital audio player. In such an example, the extracted text from the body is rendered in predefined metadata fields on the iPod when the user selects the file associated with the extracted body text in the same manner as a user selects a song in a media file. The user may advantageously view the email in the display screen of the iPod.

The method of FIG. 3 also includes storing (323) the media file (314) on a digital audio player (108). Storing (323) the media file (314) on a digital audio player (108) may be carried out by copying the media file and associated metadata containing the extracted text onto the digital audio player.

The method of FIG. 3 also includes displaying (325) the metadata (316) describing the media file (314) thereby rendering the extracted text (310) of the email message (304). Displaying (325) the metadata (316) describing the media file (314) is typically carried out by a digital audio player supporting the display of metadata associated with media files. Such digital audio players typically display, for example, metadata such as the artist and title of a song stored in a media file of a media file type supported by the digital audio player. Storing extracted email text as metadata associated with a digital file advantageously allows the extracted email text to be displayed in a digital audio player that does not support rendering conventional email.

As discussed above, extracted email text may be stored directly in the media file. For further explanation, therefore, FIG. 4 sets forth a block diagram of an MPEG file (402) such as an .mp4 file. The MPEG file of FIG. 4 includes an audio portion (318) of the media file. The audio portion of the MPEG file includes the binary audio data.

Figure 4:
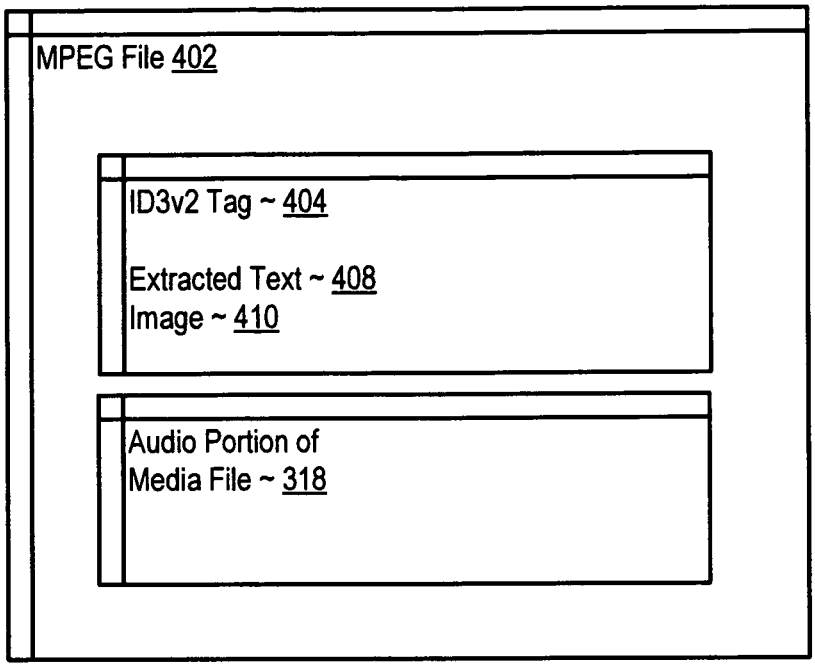
FIG. 4 sets forth a block diagram of an MPEG file such as an .mp4 file.

The MPEG file (402) of FIG. 4 has an ID3v2 tag (404) prepended to the audio portion (318) of the file that contains the extracted email text (408) and an image (410) extracted from an attachment of the email. An ID3v2 tag provides a container for metadata associated with the media file. An ID3v2 tag includes one or more fames supporting the inclusion of text, images, files, and other information. ID3v2 tags are flexible and expandable because parsers that do not support specific functions of the an ID3v2 tag will ignore those functions. ID3v2 supports Unicode thereby providing the ability to include extracted email text of many different languages. The maximum tag size of an ID3v2 tag is typically 256 megabytes and maximum frame size is typically 16 megabytes.

Figure 5:
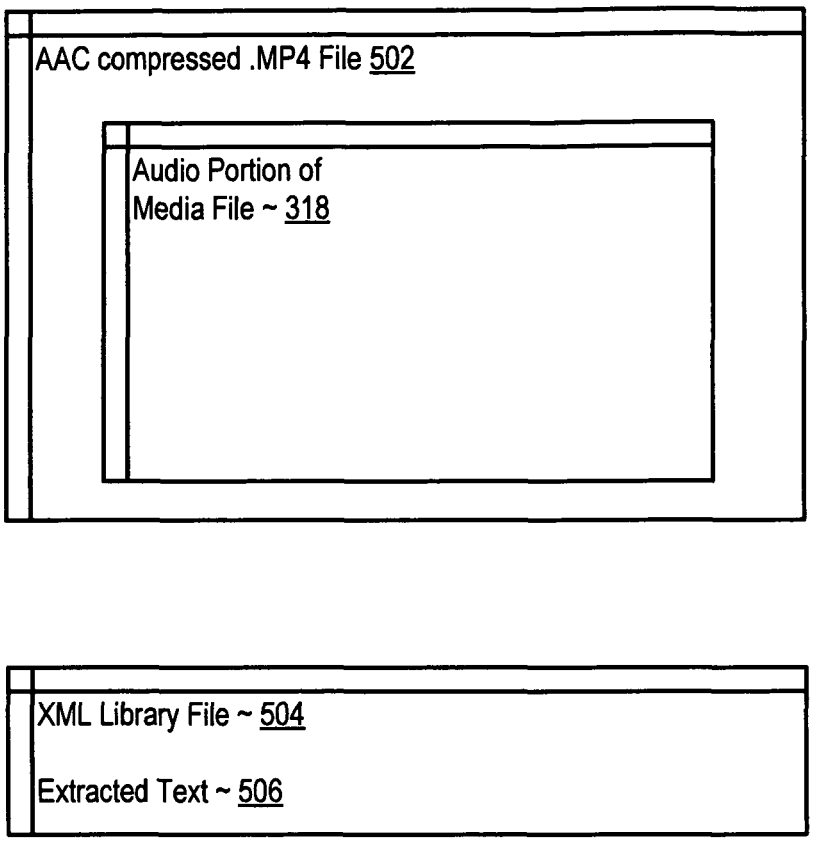
FIG. 5 sets forth a block diagram of an AAC compressed .mp4 file such as those supported by the iTunes musical jukebox and played on an iPod digital audio player.

As discussed above, the extracted email may also be associated with the media file in a metadata file. For further explanation, therefore, FIG. 5 sets forth a block diagram of an AAC compressed .mp4 file (502) such as those supported by the iTunes musical jukebox and played on an iPod digital audio player. In the example of FIG. 5 the AAC compressed .mp4 file has included in the file the binary audio portion (318) of the digital media file. The AAC compressed .mp4 file (502) of FIG. 5 also has an associated metadata file implemented as an eXtenxible markup language ('XML') library file (504) that includes the extracted text (506) from the email. iTunes digital audio application includes a single iTunes library file that contains metadata describing the contents of the media files comprising the iTunes library. The iTunes library file is implemented as an XML file, the format of which is defined by a flexible Document Type Definition ('DTD').

In the examples above, extracted email text is displayed on the display screen of a digital audio player for visual rendering of the email on the display screen of a digital audio player. Some or all of the extracted text may also be converted to speech for audio rendering by the digital audio player. For further explanation, therefore, FIG. 6 sets forth a flow chart illustrating an exemplary method for email administration for rendering email on a digital audio player that includes converting the extracted email text to speech and recording the speech in the audio portion of a media file for audio playback on the digital audio file.

Figure 6:
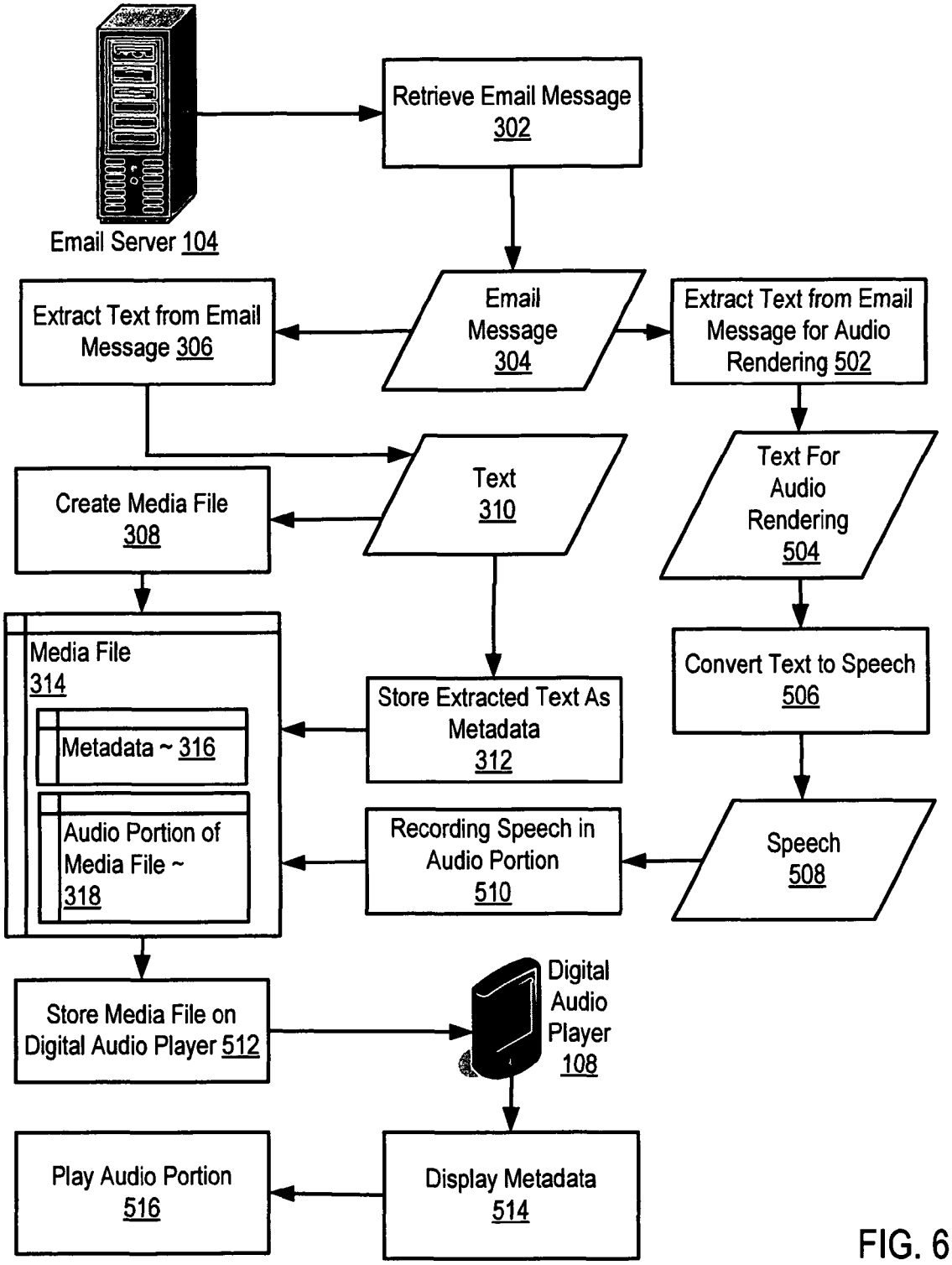
FIG. 6 sets forth a flow chart illustrating an exemplary method for email administration for rendering email on a digital audio player that includes converting the extracted email text to speech and recording the speech in the audio portion of a media file for audio playback on the digital audio file.

The method of FIG. 6 includes retrieving (302) an email message (304). Retrieving (302) an email message (304) may be carried out by retrieving one or more email messages from an email server.

The method of FIG. 6 includes extracting (306) text (310) from the email message (304) for visual rendering on the display screen of the digital audio player. The principal parts of an email message are header, body, and attachments. The header contains information including sender, intended recipient, date, intended courtesy copy recipients, subject of the message, and others as will occur to those of skill in the art. The body of the email message contains the content of the message itself. The attachments are typically files attached to the email message.

The method of FIG. 6 includes creating (308) a media file (314). Examples of media files include MPEG 3 ('.mp3') files, MPEG 4 ('.mp4') files, Advanced Audio Coding ('AAC') compressed files, Advances Streaming Format ('ASF') Files, WAV files, and many others as will occur to those of skill in the art. Creating a media file typically includes creating a media file that is supported by a digital audio player upon which email is to be rendered.

The method of FIG. 6 also includes storing (312) the extracted text (310) of the email message (304) as metadata (316) associated with the media file (314). Storing (312) the extracted text (310) of the email message (304) as metadata (316) associated with the media file (314) may be carried out by inserting the extracted text in the media file itself, such as by inserting the extracted text in an ID3 tag in an MPEG file as discussed above with reference to FIG. 4. Storing (312) the extracted text (310) of the email message (304) as metadata (316) associated with the media file (314) may be also be carried out by storing the extracted text in a metadata file associated with the media file such as by storing the extracted text in an eXtenxible markup language ('XML') library file associated with an AAC compressed MPEG 4 file as discussed above with reference to FIG. 5.

The method of FIG. 6 advantageously provides a vehicle for storing header information such as the sender, intended recipient, data, time, subject and so on as metadata in the media file. Such header information may then be displayed visually on a display screen of digital audio player.

The method of FIG. 6 also provides a vehicle for storing portions of the email such as the body of the email in the audio portion of the media file for audio rendering. The method of FIG. 6, therefore, also includes extracting text (502) from the email message (304) for audio rendering on the digital audio player (108). Extracting text from the email message according to the method of FIG. 6 may therefore also include extracting text from an email message body for audio rendering on a digital audio player.

The method of FIG. 6 also includes converting (506) the text (504) to speech (508) and recording (510) the speech (508) in the audio portion (318) of the media file (314). Converting (506) the text (504) to speech (508) and recording (510) the speech (508) in the audio portion (318) of the media file (314) may be carried out by processing the extracted text using a text-to-speech engine in order to produce a speech presentation of the extracted email text and then recording the speech produced by the text-speech-engine in the audio portion of a media file.

Examples of speech engines capable of converting extracted text to speech for recording in the audio portion of a media filed include, for example, IBM's ViaVoice Text-to-Speech, Acapela Multimedia TTS, AT&T Natural Voices™ Text-to-Speech Engine, and Python's pyTTS class. Each of these text-to-speech engines is composed of a front end that takes input in the form of text and outputs a symbolic linguistic representation to a back end that outputs the received symbolic linguistic representation as a speech waveform.

Typically, speech synthesis engines operate by using one or more of the following categories of speech synthesis: articulatory synthesis, formant synthesis, and concatenative synthesis. Articulatory synthesis uses computational biomechanical models of speech production, such as models for the glottis and the moving vocal tract. Typically, an articulatory synthesizer is controlled by simulated representations of muscle actions of the human articulators, such as the tongue, the lips, and the glottis. Computational biomechanical models of speech production solve time-dependent, 3-dimensional differential equations to compute the synthetic speech output. Typically, articulatory synthesis has very high computational requirements, and has lower results in terms of natural-sounding fluent speech than the other two methods discussed below.

Formant synthesis uses a set of rules for controlling a highly simplified source-filter model that assumes that the glottal source is completely independent from a filter which represents the vocal tract. The filter that represents the vocal tract is determined by control parameters such as formant frequencies and bandwidths. Each formant is associated with a particular resonance, or peak in the filter characteristic, of the vocal tract. The glottal source generates either stylized glottal pulses for periodic sounds and generates noise for aspiration. Formant synthesis generates highly intelligible, but not completely natural sounding speech. However, formant synthesis has a low memory footprint and only moderate computational requirements. Concatenative synthesis uses actual snippets of recorded speech that are cut from recordings and stored in an inventory or voice database, either as waveforms or as encoded speech. These snippets make up the elementary speech segments such as, for example, phones and diphones. Phones are composed of a vowel or a consonant, whereas diphones are composed of phone-to-phone transitions that encompass the second half of one phone plus the first half of the next phone. Some concatenative synthesizers use so-called demi-syllables, in effect applying the diphone method to the time scale of syllables. Concatenative synthesis then strings together, or concatenates, elementary speech segments selected from the voice database, and, after optional decoding, outputs the resulting speech signal. Because concatenative systems use snippets of recorded speech, they have the highest potential for sounding like natural speech, but concatenative systems require large amounts of database storage for the voice database.

The method of FIG. 6 also includes storing (512) the media file (314) on a digital audio player (108). Storing (512) the media file (314) on a digital audio player (108) may be carried out by copying the media file and associated metadata containing the extracted text onto memory of the digital audio player.

The method of FIG. 6 also includes displaying (514) the metadata (316) describing the media file (314). Displaying (514) the metadata (316) describing the media file (314) is typically carried out by a digital audio player supporting the display of metadata associated with media files. Such digital audio players typically display, for example, metadata such as the artist and title a song stored in a media file of a media file type supported by the digital audio player. Storing extracted email text as metadata associated with a digital file advantageously allows the extracted email text to be displayed in a digital audio player that does not support rendering conventional email.

The method of FIG. 6 also includes playing (516) the audio portion (318) containing the speech (508). Playing (516) the audio portion (318) containing the speech (508) advantageously renders an audio speech representation of the extracted text of the email thereby allowing the email to be rendered on a digital audio player that does not support conventional email.

Exemplary embodiments of the present invention are described largely in the context of a fully functional computer system for email administration for rendering email on a digital audio player. Readers of skill in the art will recognize, however, that the present invention also may be embodied in a computer program product disposed on signal bearing media for use with any suitable data processing system. Such signal bearing media may be transmission media or recordable media for machine-readable information, including magnetic media, optical media, or other suitable media. Examples of recordable media include magnetic disks in hard drives or diskettes, compact disks for optical drives, magnetic tape, and others as will occur to those of skill in the art. Examples of transmission media include telephone networks for voice communications and digital data communications networks such as, for example, Ethernets™ and networks that communicate with the Internet Protocol and the World Wide Web. Persons skilled in the art will immediately recognize that any computer system having suitable programming means will be capable of executing the steps of the method of the invention as embodied in a program product. Persons skilled in the art will recognize immediately that, although some of the exemplary embodiments described in this specification are oriented to software installed and executing on computer hardware, nevertheless, alternative embodiments implemented as firmware or as hardware are well within the scope of the present invention.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method for email administration for rendering email on a digital audio player having a primary function of playing audio media files in a format having an audio portion for storing audio data and an associated metadata portion for storing non-audio data, the method comprising:

retrieving an email message;

extracting text at least from a body of the email message such that the extracted text includes the content of the email message;

creating an audio media file in the format supported by the digital audio player;

storing at least a portion of the extracted text including the content of the email message as data in a metadata portion associated with the audio media file; and transmitting the audio media file and the metadata portion to the digital audio player for visually displaying at least the portion of the text extracted from the email message on the digital audio player so that the content of the email message can be visually displayed on the digital audio player that does not support rendering conventional email;

wherein the retrieving, extracting, creating, storing and transmitting are performed by at least one computer that is distinct and remote from the digital audio player.

2. The method of claim 1 wherein:

creating the audio media file further comprises creating an MPEG file; and storing at least the portion of the extracted text of the email message further comprises inserting the extracted text in a metadata portion of the MPEG file.

3. The method of claim 2 wherein inserting the extracted text in a metadata portion of the MPEG file further comprises inserting the extracted text as an ID3 tag of the MPEG file.

4. The method of claim 1 wherein storing at least the portion of the extracted text of the email message further comprises storing the extracted text in a data file associated with the audio media file.

5. The method of claim 4 wherein the data file is an eXtenxible markup language ('XML') file.

6. The method of claim 1, wherein the extracted text includes an indication of a sender of the email message.

7. The method of claim 6, further comprising:

converting at least the body of the email message to speech; and inserting the speech in an audio portion of the audio media file.

8. A system for email administration for rendering email on a digital audio player having a primary function of playing audio media files in a format having an audio portion for storing audio data and an associated metadata portion for storing non-audio data, the system comprising:

a computer processor that is distinct and remote from the digital audio player;

a computer memory operatively coupled to the computer processor, the computer memory having disposed within it computer program instructions, which when executed by the computer processor, cause the system to carry out the steps of:

retrieving an email message;

extracting text at least from a body of the email message such that the extracted text includes the content of the email message;

creating an audio media file in the format supported by the digital audio player;

storing at least a portion of the extracted text including the content of the email message as data in a metadata portion associated with the audio media file; and transmitting the audio media file and the metadata portion to the digital audio player for visually displaying at least the portion of the text extracted from the email message on the digital audio player so that the content of the email message can be visually displayed on the digital audio player that does not support rendering conventional email.

9. The system of claim 8 wherein:

creating the audio media file further comprises creating an MPEG file; and storing at least the portion of the extracted text of the email message further comprises inserting the extracted text in a metadata portion of the MPEG file.

10. The system of claim 9 wherein inserting the extracted text in a metadata portion of the MPEG file further comprises inserting the extracted text as an ID3 tag of the MPEG file.

11. The system of claim 8 wherein storing at least the portion of the extracted text of the email message further comprises storing the extracted text in a data file associated with the audio media file.

12. The system of claim 8 wherein the computer memory also has disposed within it computer program instructions, which when installed and executed on the computer processor, cause the system to carry out the step of storing the audio media file on the digital audio player.

13. The system of claim 8 wherein the computer memory also has disposed within it computer program instructions, wherein when installed and executed on the computer processor, cause the system to carry out the steps of:

converting at least the body of the email message to speech; and inserting the speech in an audio portion of the audio media file.

14. A computer program product for email administration for rendering email on a digital audio player having a primary function of playing audio media files in a format having an audio portion for storing audio data and an associated metadata portion for storing non-audio data, the computer program product embodied on at least one recordable non-transitory computer-readable medium, the computer program product comprising computer program instructions, which when executed on at least one computer that is distinct and remote from the digital audio player, cause the at least one computer to carry out the steps of:

retrieving an email message;

extracting text at least from a body of the email message such that the extracted text includes the content of the email message;

creating an audio media file in the format supported by the digital audio player;

storing at least a portion of the extracted text including the content of the email message as data in a metadata portion associated with the audio media file; and transmitting the audio media file and the metadata portion to the digital audio player for visually displaying at least the portion of the text extracted from the email message on the digital audio player so that the content of the email message can be visually displayed on the digital audio player that does not support rendering conventional email.

15. The computer program product of claim 14 wherein:

creating the audio media file further comprises creating an MPEG file; and storing at least the portion of the extracted text of the email message further comprises inserting the extracted text in a metadata portion of the MPEG file.

16. The computer program product of claim 15 wherein inserting the extracted text in a metadata portion of the MPEG file further comprises inserting the extracted text is an ID3 tag of the MPEG file.

17. The computer program product of claim 14 wherein storing at least the portion of the extracted text of the email message further comprises storing the extracted text in a data file associated with the audio media file.

18. The computer program product of claim 14 further comprising computer program instructions that, when executed on the at least one computer, adapt the at least one computer to carry out the steps of:

converting at least the body of the email message to speech; and inserting the speech in an audio portion of the audio media file.

19. The computer program product of claim 14 further comprising computer program instructions that, when executed on the at least one computer, adapt the at least one computer to store the audio media file on a digital audio player.

20. A method for rendering email on a digital audio player, the method comprising acts of:

extracting, by at least one processor distinct from the digital audio player, text at least from a body of an email message such that the extracted text includes the content of the email message; and storing, by the at least one processor, at least a portion of the extracted text including the content of the email message in a metadata portion associated with an audio file that is supported by the digital audio player, wherein the content of the email message can be visually displayed on the digital audio player that does not support rendering conventional email.

21. A manufactured, non-transitory computer-readable medium embodying machine-readable instructions that, when executed by at least one processor that is distinct from a digital audio player, adapt the at least one processor to execute acts of:

extracting text at least from a body of an email message such that the extracted text includes the content of the email message; and storing at least a portion of the extracted text including the content of the email message in a metadata portion associated with an audio file that is supported by the digital audio player, wherein the content of the email message can be visually displayed on the digital audio player that does not support rendering conventional email.

* * * * *